US005309996A

United States Patent [19]

Sutton

[11] Patent Number: 5,309,996

[45] Date of Patent: May 10, 1994

[54] METHODS OF PRIMARY CEMENTING OF WELLS

[75] Inventor: David L. Sutton, Duncan, Okla.

[73] Assignee: Halliburton Company, Duncan, Okla.

[21] Appl. No.: 874,776

[22] Filed: Apr. 27, 1992

[51] Int. Cl.[5] ..... E21B 33/14

[52] U.S. Cl. ..... 166/286; 166/285

[58] Field of Search ..... 166/286, 285

[56] References Cited

U.S. PATENT DOCUMENTS

| | | | |
|---|---|---|---|
| 2,309,791 | 2/1943 | Sanders | 166/286 X |
| 2,609,881 | 9/1952 | Warren | 166/285 |
| 2,675,082 | 4/1954 | Hall | 166/285 |
| 3,205,945 | 9/1965 | Holt | 166/286 |
| 3,376,921 | 4/1968 | Manry et al. | 166/285 X |
| 3,557,875 | 1/1971 | Solum et al. | 166/286 |
| 3,951,208 | 4/1976 | Delano | 166/78 |
| 4,919,208 | 4/1990 | Schneider | 166/286 |

FOREIGN PATENT DOCUMENTS

| | | | |
|---|---|---|---|
| 1419285 | 12/1975 | United Kingdom | 166/285 |

OTHER PUBLICATIONS

SPE Paper No. 22776 presented to the Society of Petroleum Engineers on Oct. 6-9, 1991, Sutton et al., entitled "Low-Rate Pipe Movement During Cement Gelation to Control Gas Migration and Improve Cement Bond".

*Primary Examiner*—Hoang C. Dang

*Attorney, Agent, or Firm*—Thomas R. Weaver; Robert A. Kent; C. Clark Dougherty, Jr.

[57] ABSTRACT

Methods and apparatus for cementing a pipe in a well bore penetrating one or more subterranean gas-containing formations without incurring substantial gas inflow are provided. The methods basically comprise the steps of placing a hydraulic cement slurry in the annulus between the pipe and the well bore, and moving the pipe during the transition period of the slurry. The moving of the pipe maintains the hydrostatic pressure exerted by the slurry on the gas-containing formations and prevents gas flow into the slurry and the well bore. The movement of the pipe is stopped when the slurry develops sufficient gel strength to substantially block gas flow through the well bore.

6 Claims, 3 Drawing Sheets

METHODS OF PRIMARY CEMENTING OF WELLS

BACKGROUND OF THE INVENTION

1. Field of the Invention

The present invention relates to methods and apparatus for carrying out primary cementing operations in a well bore without incurring substantial gas inflow.

2. Description of the Prior Art

In the primary cementing of wells, a pipe disposed in a well bore, e.g., casing, is cemented therein whereby the pipe is bonded to the walls of the well bore. The bonding serves to maintain the pipe in place and to prevent subterranean formation fluids from communicating between zones or to the surface by way of the annulus between the well bore and the pipe. Typically, primary cementing is carried out by pumping a cement slurry downwardly through the pipe to the bottom thereof and then upwardly into the annulus. The cement slurry is displaced out of the pipe and into the annulus by a displacement fluid and upon being placed in the annulus, the cement slurry is allowed to set into a hard impermeable mass therein.

When one or more of the subterranean formations or zones penetrated by the well bore contain pressurized gas, a problem often encountered involves the flow of gas into the cement slurry and into the well bore prior to when the cement slurry sets. Such gas can flow to the surface, create communication between producing or other subterranean formations or zones and can, when in high enough volume, create a blow out shortly after the primary cementing operation is complete.

The occurrence of gas flow in a cemented pipe-well bore annulus relates to the inability of the cement slurry to transmit hydrostatic pressure during the transition period in which the slurry converts from a true fluid to a partially self supporting semisolid as a result of the development of static gel strength. Static gel strength can be defined as internal rigidity in the matrix of the cement that resists a force placed upon it. The development of static gel strength starts immediately after placement of the cement slurry in the annulus and continues to increase as the cement hydrates or sets. At a point before initial set, the cement slurry develops a static gel strength high enough to prevent pressurized gas from moving through it.

When the cement slurry is initially placed in the annulus, it exerts hydrostatic pressure on gas-containing formations penetrated by the well bore whereby gas flow into the cement slurry and into the well bore is prevented. However, after the cement slurry becomes partially self-supporting, the ongoing hydration reactions in the slurry and fluid losses therefrom cause volume reductions to take place in the slurry which in turn causes the hydrostatic pressure exerted by the slurry to be reduced. When the hydrostatic pressure is reduced below the pressure of the gas, gas flow through the slurry contained in the well bore takes place.

A number of methods and special hydraulic cement compositions have been developed and used to minimize gas inflow during primary cementing. Examples include multiple stage cementing methods, maintaining a back pressure on the annulus and/or including special additives in the cement composition such as latexes, special fluid loss prevention additives, in situ gas generating additives, etc. While the prior methods and cement compositions have achieved varying degrees of success, they are relatively expensive and problems caused by gas inflow still often result.

Thus, there is a need for improved methods and apparatus for carrying out primary cementing operations in wells whereby expensive cement slurry additives are not required and gas flow into the cement slurry and well bore is substantially prevented.

SUMMARY OF THE INVENTION

By the present invention, improved methods and apparatus for cementing a pipe in a well bore penetrating one or more subterranean gas-containing formations without incurring substantial gas flow into the cement and gas migration along the well bore are provided which overcome the shortcomings of the prior art and meet the need described above. The methods of the invention basically comprise placing a hydraulic cement slurry in the annulus between the pipe and the well bore, and moving the pipe during the transition period of the slurry. The transition period is the time period during which the static gel strength of the slurry increases from its initial value to a value sufficiently high to prevent gas migration along the well bore. The movement of the pipe causes the hydrostatic pressure exerted by the slurry to be substantially maintained and gas flow into the slurry and well bore to be substantially prevented. The movement of the pipe is stopped when the slurry develops sufficient gel strength to substantially block gas flow through the cement filled annulus in the well bore. After stopping the pipe movement, the volume of the cement slurry in the annulus continues to reduce as a result of the continued hydration of the cement and fluid loss to subterranean formations penetrated by the well bore. As a result, the hydrostatic pressure exerted by the cement slurry can and often does drop to a level equal to or below the pressure level of gas contained in one or more subterranean zones penetrated by the well bore thereby allowing gas to flow into the pore space of the cement. However, the gas is prevented by the substantial gel strength of the cement slurry from migrating through the slurry along the well bore.

Thus, it is a general object of the present invention to provide improved methods and apparatus for the primary cementing of wells.

A further object of the present invention is the provision of methods and apparatus for cementing a pipe in a well bore using ordinary hydraulic cement compositions without incurring substantial gas flow into the cement and the well bore.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 1:
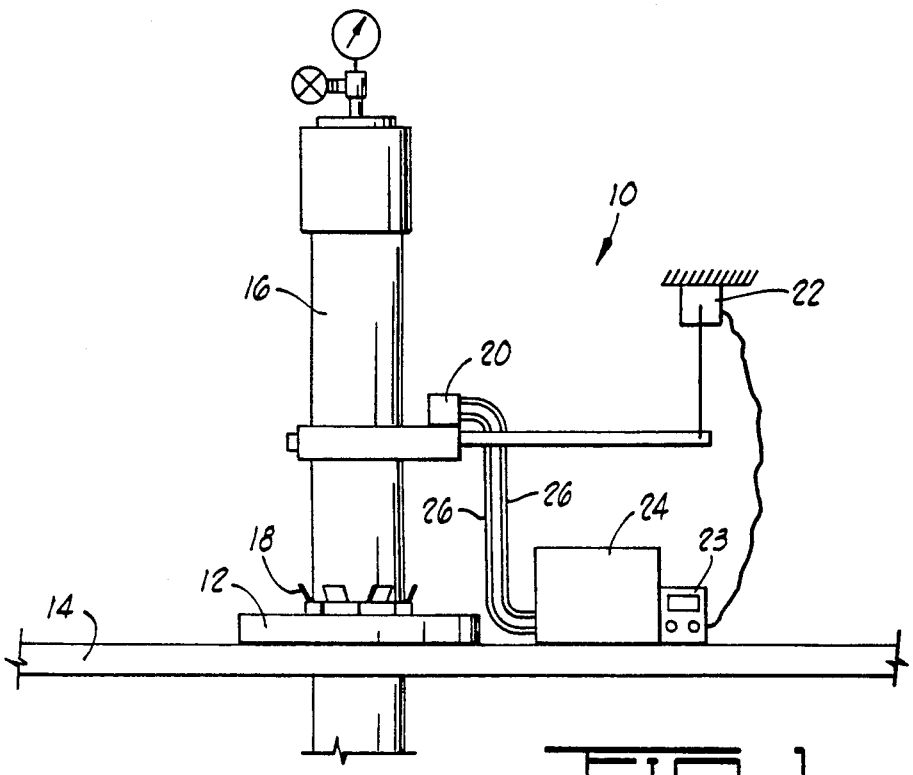
FIG. 1 is a side elevational view of a pipe, such as casing, to be cemented in a well bore having one form of the apparatus of the present invention connected thereto.

The cement compositions which are ordinarily used in primary well cementing and which are also utilized in accordance with the present invention are pumpable aqueous hydraulic cement slurries containing various components which, after placement in the annulus to be cemented, set into hard substantially impermeable masses having required compressive strengths. While various hydraulic cements can be utilized for forming the cement slurries, Portland Cement is preferably utilized and can be, for example, one or more of the various types of Portland Cement identified as a API Classes A-H and J cements. These cements are identified and defined in *API Specification for Materials and Testing for Well Cements,* API Spec. 10 of the American Petroleum Institute.

The thickening and set times of cement compositions are strongly dependent upon temperature and pressure. To obtain optimum results in oil and gas well applications, a variety of additives are often included in the cement compositions to vary slurry density, increase or decrease strength, accelerate or retard thickening time, control fluid loss, reduce slurry viscosity, increase resistance to corrosive fluids, and the like. Essentially, a cement composition meeting the specifications of the American Petroleum Institute includes cement, water and other additives to provide a cement slurry appropriate for the conditions existing in the individual well to be cemented.

The methods of the present invention for performing primary cementing in oil and gas wells, i.e., cementing a pipe such as casing or a liner in a well bore penetrating one or more subterranean gas-containing formations are comprised of the following steps.

After the usual mud circulation and placement of spacer, water and bottom plug as is appropriate under the conditions encountered, a hydraulic cement slurry is placed in the annulus between the pipe disposed in the well bore and the walls of the well bore. The placement of the cement slurry is accomplished by pumping the slurry downwardly within the pipe to the bottom end thereof and then upwardly into the annulus. The cement column is displaced into the annulus with water or other displacement fluid whereby it completely fills the portion of the annulus to be cemented. During the placement of the cement slurry in the annulus, the cement slurry, displacement fluids and other fluids involved have the properties of true fluids and exert hydrostatic pressures on gas-containing formations penetrated by the well bore sufficient to prevent the flow of gas into the well bore through the fluids therein.

After being placed, the column of cement slurry in the annulus begins its transition period whereby it increasingly develops static gel strength and converts from a true fluid to a partially self-supporting column. As time goes on, the column converts to a fully supporting column and sets into a hard substantially impermeable mass. The term "transition period" is used herein to mean the period of time from when the cement slurry is a true fluid to a time when the cement slurry develops static gel strength high enough to prevent gas from moving through it. Tests have indicated that a gel strength of about 500 pounds per 100 square feet is sufficient to prevent such movement.

When the cement slurry becomes partially self-supporting but still does not have sufficient gel strength to prevent gas flow, the potential for gas entry into the cement column is greatest and gas entry often does occur. That is, although the original hydrostatic pressure is trapped within the gelled cement matrix, volume reductions in the aqueous phase of the cement slurry due to ongoing cement hydration reactions therewith and loss of the aqueous phase to subterranean formations in contact with the cement slurry cause the hydrostatic pressure to decrease. When the hydrostatic pressure decreases to a point below the pressure of the gas contained in one or more of the subterranean formations penetrated by the well bore, gas inflow and gas migration in the well bore through the cement slurry results.

In accordance with the present invention, the flow of gas into the cement slurry and into the well bore during the transition period of the cement slurry is prevented by moving the pipe which is being cemented during that period. That is, after the cement slurry is placed, the pipe is continuously moved whereby the hydrostatic pressure exerted by the slurry on gas-containing formations is substantially maintained and gas entry is substantially prevented. Once the cement slurry develops sufficient gel strength to block gas migration in the annulus between the pipe and the well bore, the movement of the pipe is stopped and the cement slurry sets into a hard substantially impermeable mass therein. As mentioned above, the gel strength of the cement slurry when the movement is stopped is generally at a level of about 500 pounds per 100 square feet.

The movement of the pipe for maintaining the hydrostatic pressure of the cement slurry can be a rotational movement or a vertical reciprocation movement, i.e., vertical up and down reciprocation. If the pipe is rotated, the rotation is preferably continuous and in one direction during the transition period until the slurry develops sufficient gel strength to substantially block gas flow thereinto, i.e., 500 pounds per 100 square feet. Generally, the pipe is rotated at a peripheral surface speed in the range of from about 7 to about 30 feet per minute. While the speed at which the pipe is rotated can be constant, the pipe is preferably rotated at a higher speed initially, e.g., about 25 feet per minute and decreased to a slower speed, e.g., about 10 feet per minute, during the latter part of the transition period.

Instead of rotating the pipe, the pipe can be vertically reciprocated. That is, the pipe can be reciprocated on a stroke having a relatively short length, generally a length in the range of from about 2 inches to about 60 inches, at a rate of one down and up cycle per a time in the range of from about 2 seconds to about 60 seconds. More preferably, the stroke length is in the range of from about 8 inches to about 10 inches and the cycle time is in the range of from about 15 seconds to about 20 seconds. The reciprocation is preferably continuous during the transition period and as described above for rotation, the reciprocation is preferably faster at the beginning of the transition period and decreased to a lower rate at the end of the period. Like the rotation, the reciprocation is stopped when the cement slurry has developed sufficient gel strength to prevent the inflow of gas, i.e., a gel strength of about 500 pounds per 100 square feet.

The movement of the pipe during the transition period of the cement slurry prevents the loss of hydrostatic pressure in the cement slurry filled annulus during the transition period. It is believed that a thin layer of slurry next to the pipe is maintained in a fluid state which in turn maintains the hydrostatic pressure. When the movement of the pipe is stopped, the thin layer very rapidly develops gel strength to the level which blocks the flow of gas into the well bore.

As will be understood, the pipe can be moved during the transition period in any desired manner or sequence so that the hydrostatic pressure is maintained but the column of cement slurry is not disturbed to the point whereby it is prevented from reaching the required gel strength. As mentioned, the pipe is moved until the cement slurry reaches a gel strength sufficient to prevent gas migration along the well bore at which time the movement is stopped. Upon stopping the movement, the cement slurry sets into a hard substantially impermeable mass without allowing gas migration or substantial gas inflow.

Thus, the methods of the present invention prevent or substantially prevent the inflow of gas through the cement slurry and gas migration along the well bore after primary cementing and do not require the use of expensive special cement compositions and/or additives.

Referring now to the drawings, and particularly to FIG. 1, an apparatus which can be utilized for rotating the pipe in accordance with this invention is illustrated and generally designated by the numeral 10.

The apparatus 10 is comprised of a rotatable support table 12 rotatably connected to a rig floor 14 or the like. The upper end portion of a pipe 16, e.g., casing, extends through a central opening in the rotatable support table 12. As will be understood, the pipe 16 extends below the floor 14 into a well bore (not shown) and within the well bore to a point near the bottom thereof. The pipe 16 is held within the opening in the rotatable support table 12 by conventional removable slips 18. The slips 18 are wedged between the pipe 16 and the opening in the rotatable table 12 whereby the pipe 16 is prevented from moving downwardly.

Removably attached to the pipe 16 above the rotatable support table 12 and slips 18 are a set of hydraulically operated power tongs 20. The power tongs 20 are attached to a load sensing device 22 which is in turn operably connected to a control apparatus 23 connected to the hydraulic power unit 24. The hydraulic power unit 24 is hydraulically connected to the power tongs 20 by hoses 26.

In operation of the apparatus 10, the pipe 16 is run in the well bore and set on the slips 18 after which the drilling mud is circulated in the manner and for a time well known to those skilled in the art. The spacer, water and bottom plug are then pumped as required followed by a hydraulic cement slurry. The cement slurry is pumped and displaced into position within the annulus after which the pumping and hoisting equipment are removed from the pipe 16. The hydraulic power tongs 20 are then connected to the pipe 16 and the pipe 16, slips 18 and support table 12 are rotated in the manner and at the speed described above. The rotation is continued until the increase in torque load on the power tongs 20 as sensed by the sensing device 22 reaches a level equivalent to a cement slurry gel strength of about 500 pounds per 100 square feet. Generally, this will be a torque increase in the range of from about 150 to about 500 pounds per 100 square feet of pipe surface in contact with the cement slurry.

Figure 2:
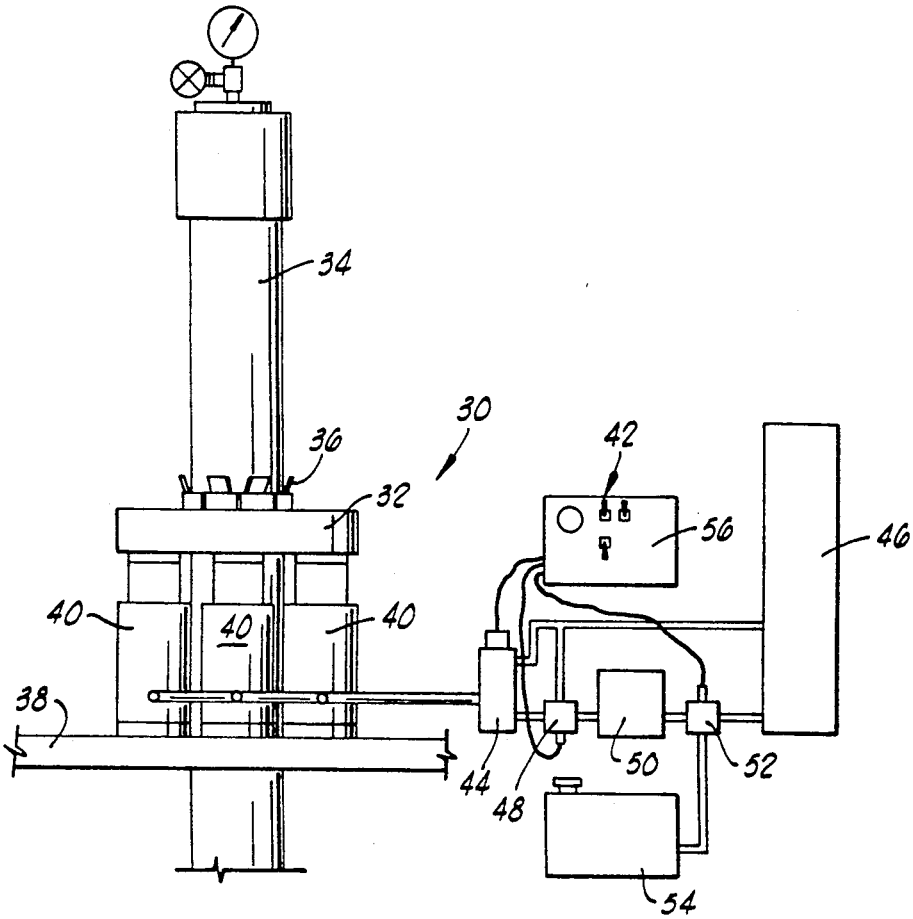
FIG. 2 is a side elevational view similar to FIG. 1 but showing an alternate apparatus of the present invention.

Referring now to FIG. 2, an alternate apparatus for moving the pipe is illustrated and generally designated by the numeral 30. The apparatus 30 includes a load support table 32 having a central opening therein through which the upper end portion of a pipe 34 disposed in a well bore extends. The pipe 34 is held within the opening in the support table 32 by slips 36. The load support table 32 is held above a floor 38 by a plurality of hydraulically operated power cylinders 40. The pipe 34 and support table 32 are free to move up and down in response to movement imparted to the support table 32 by the power cylinders 40. The hydraulic cylinders 40 are operably connected to a hydraulic power unit generally designated by the numeral 42. The hydraulic power unit 42 can take a variety of forms, but generally is comprised of a three- way control valve 44 having a common port connected to the cylinders 40, a port connected to a hydraulic fluid accumulator 46 and a port connected to the common port of a second three-way control valve 48. A port of the three-way control valve 48 is connected to a hydraulic pump 50 with the other port being connected to the accumulator 46. A third three-way control valve 52 is provided, the common port of which is connected to the inlet of the pump 50. A port of the valve 52 is connected to a hydraulic fluid reservoir 54 with the other port being connected to the accumulator 46. The three-way control valves 44, 48 and 52 and the pump 50 are controlled by a master controller 56 which includes means for sensing the vertical load on the cylinders 40.

In operation of the apparatus 30, after a cement slurry has been placed in the annulus as described above, the pipe 34 and support table 32 are vertically reciprocated by the hydraulic power unit 42. That is, the pipe 34 is reciprocated on a stroke having a length in the range of from about 2 inches to about 60 inches, preferably from about 8 inches to about 10 inches, at a rate of one up and down cycle per a time in the range of from about 2 seconds to about 60 seconds, preferably from about 15 seconds to about 20 seconds. The upward movement of the support table 32 and pipe 34 is brought about by the pumping of hydraulic fluid into the cylinders 40 from the hydraulic pump 50 by way of the valves 48 and 44. The downward movement of the support table 32 and pipe 34 is brought about by switching the valve 44 whereby the hydraulic fluid flows from the cylinders 40 into the hydraulic fluid accumulator 46. The accumulator 46 is initially loaded with hydraulic fluid from the reservoir 54 by switching the three-way valves 52 and 48 whereby the pump 50 draws fluid from the reservoir 54 and pumps it into the accumulator 46. The accumulator 46 is also pressurized with a gas, e.g., nitrogen, to a pressure level which balances the net weight of the pipe 34. The controls included in the control box 56 cause the hydraulic power unit to reciprocate the support table 32 and pipe 34 at a preset rate and to stop the reciprocation when the increase in lift load of the pipe 34 reaches a level equivalent to a cement slurry gel strength of about 500 pounds per 100 square feet. Such a gel strength translates to a lift load increase equivalent to about 300 pounds per 100 square feet of pipe surface in contact with the cement slurry.

Figure 3:
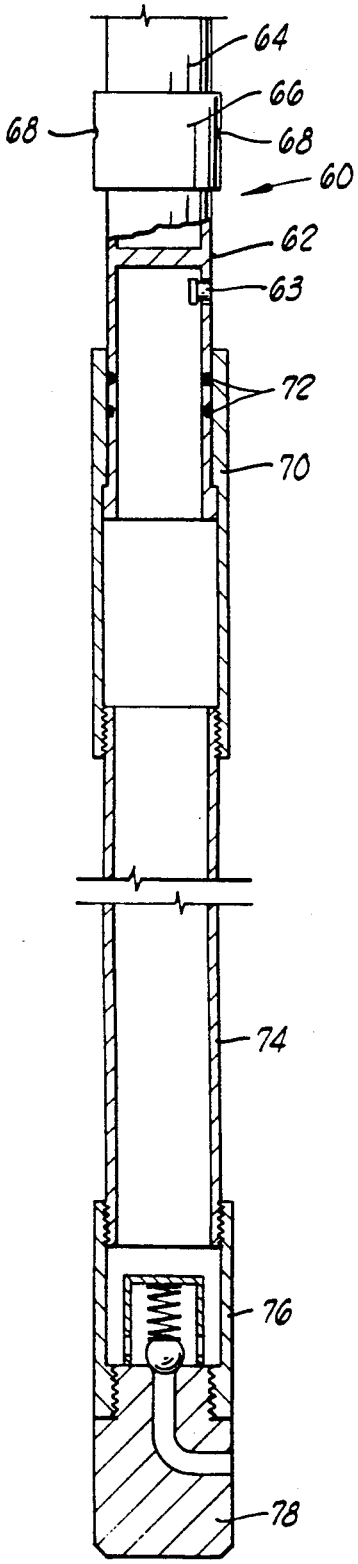
FIG. 3 is a cross-sectional view of a slip joint which can be utilized in accordance with the present invention.

In order to prevent surging in the cement slurry as the pipe 34 is reciprocated, a slip joint is preferably connected to the bottom of the pipe 34 which is maintained in contact with the bottom of the well bore within which the pipe 34 is disposed. Such a slip joint is illustrated in FIG. 3 and is generally designated by the numeral 60.

The slip joint 60 includes a cylindrical mandril 62 which is threadedly connected to the bottom end of a pipe 64 disposed in a well bore (not shown) by a collar 66. Conveniently, the collar 66 can be a conventional cementing collar which includes outlet ports 68 through which the cement slurry placed in the annulus is discharged. The mandril 62 includes a gas pre-charge fill valve 63 disposed therein.

A reciprocation chamber 70 is positioned over a portion of the mandril 62 whereby the mandril 62 can be moved downwardly and upwardly within the chamber 70 on a short stroke, e.g., a stroke having a length of from about 8 to about 10 inches. Conventional seal members 72 are disposed between the external surface of the mandril 62 and the internal surface of the chamber 70 for providing a seal therebetween.

Threadedly connected to the bottom end of the reciprocation chamber is a mud chamber 74; and threadedly connected to the bottom end of the mud chamber 74 is a collar 76, the bottom end of which is threadedly connected to a check valve plug assembly 78.

In operation of the slip joint 60, it is threadedly connected to the bottom end of the pipe to be cemented in a well bore and the pipe is lowered into the well bore whereby the plug 78 at the bottom end of the slip joint 60 is in contact with the bottom of the well bore.

The slip joint 60 is pre-charged with a gas such as nitrogen by way of the pre-charge fill valve 63 in the mandril 62 to a predetermined pressure. When the pipe 64 is positioned with the bottom of the slip joint 60 in contact with the bottom of the well bore and is moved downwardly, the mandril 62 moves downwardly within the reciprocation chamber 70 and the gas within the slip joint 60 is compressed. When the pipe 64 is moved upwardly the compressed gas expands so that the mandril 62 moves upwardly within the reciprocation chamber 70 and the slip joint 60 remains in contact with the bottom of the well bore. The check valve in the check valve plug assembly 78 allows hydrostatic pressure from the well bore to enter the mud chamber 74 if the hydrostatic pressure exceeds the gas pre-charge pressure.

Thus, the slip joints 60 remains in contact with the bottom of the well bore as the pipe 64 is reciprocated thereby preventing the cement slurry in the annulus from surging as a result of the pipe reciprocation.

Figure 4:
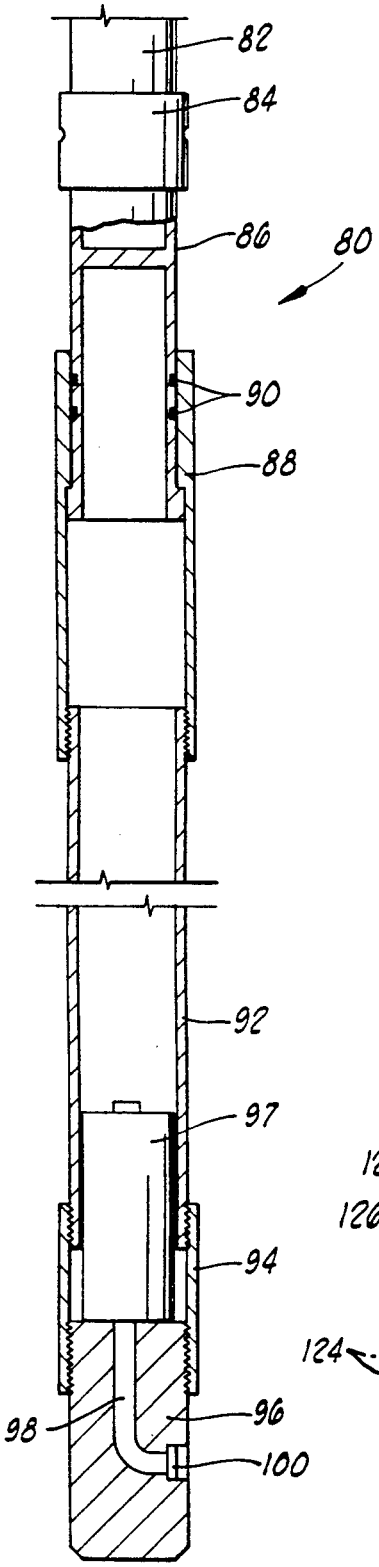
FIG. 4 is a cross-sectional view of an alternate form of slip joint which can be utilized in accordance with the present invention.

Referring now to FIG. 4, an alternate slip joint apparatus is illustrated and generally designated by the numeral 80. The slip joint 80 is threadedly connected to the bottom end of a pipe 82 to be cemented in a well bore by a cementing collar 84. The slip joint 80 includes a mandril 86, a reciprocation chamber 88 and a mud chamber 92 which are identical to the mandril 62, reciprocation chamber 70 and mud chamber 74 of the slip joint 60 described above. A pair of seal members 90 are disposed between the external surface of the mandril 86 and the internal surface of the reciprocation chamber 88 for providing a seal therebetween. Instead of the check valve plug assembly 78 of the slip joint 60, the slip joint 80 includes a rupture disk plug assembly 96 connected to the bottom end of the mud chamber 92 by a collar 94. The rupture disk plug 96 includes a passage 98 which communicates from the bottom end of the plug 96 to the interior of the mud chamber 92, and a conventional rupture disk 100 is sealingly disposed over the passageway 98. Instead of the gas precharge utilized in the slip joint 60, the slip joint 80 includes an insulated liquid nitrogen container 97 which is placed in the slip joint 80 just prior to running it in the well bore. The liquid nitrogen contained in the container 97. evaporates as the pipe 82 is run and charges the slip joint 80 with compressible nitrogen gas. The amount of liquid nitrogen placed in the chamber is that quantity needed after evaporation which provides a volume of gas sufficient to fill the internal volume of the slip joint to a pressure essentially equal to the predicted bottom hole hydrostatic pressure after the cement has been displaced into the annulus. The purpose of the rupture disk 100 is to prevent catastrophic failure of the slip joint assembly in the event placement in the intended downhole position is inadvertently delayed. If the slip joint is not under high hydrostatic pressure when the liquid nitrogen has evaporated the strength of the chamber 92 can be exceeded. An alternate placement for the rupture disk is in the mandril 86. The principle advantage of using liquid nitrogen in lieu of pre-charging with gas is a substantial reduction in pressure in the slip joint at surface conditions before the liquid nitrogen evaporates. This allows the wall thickness of chamber 92 and mandril 86 to be reduced as compared to the embodiment shown in FIG. 3.

The operation of the slip joint 80 is the same as the operation of the slip joint 60 described above whereby surges in the cement slurry during reciprocation of the pipe 82 are prevented.

Figure 5:
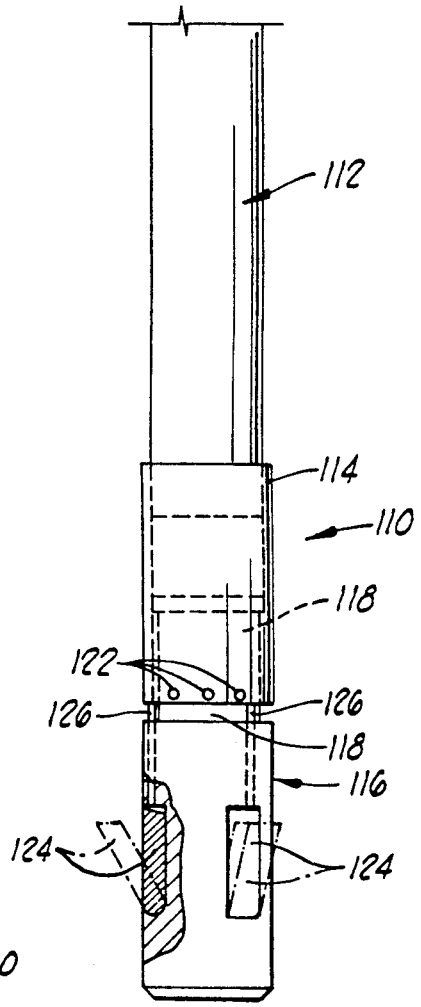
FIG. 5 is a side partially sectional view of a mechanical anchor apparatus attached to a slip joint which can be utilized in accordance with the present invention.

Referring now to FIG. 5, a mechanical anchor slip joint apparatus 110 is shown which can optionally be connected at the bottom end of the pipe 112. The anchor slip joint apparatus 110 is connected at the bottom end of a pipe 112 by a thread in the top of cylinder 114.

An anchor member, generally designated by the numeral 116, is connected to the cylinder 114 by means of mandril 118. The anchor member 116 includes a mandril portion 118 slidably retained within the bottom end of the cylinder 114 whereby when the anchor member 116 contacts the bottom of the well bore and the pipe 112 is moved a short distance further downwardly, the cylinder 114 and anchor member 116 are moved towards each other. The mandril 118 slips upward toward pipe 112. A plurality of shear pins 122 are disposed in openings in the cylindrical portion 118 of the anchor member 116 and in the cylinder 114 for preventing the anchor member 116 from moving towards the cylinder 114 until the anchor member 116 is in contact with the bottom of the well bore and the force of the continued downward movement of the slip joint 112 causes the shear pins 122 to shear.

The anchor member 116 includes a plurality of spring loaded anchor lugs 124 which are folded inwardly when the pipe 112 is being run in the well bore and the shear pins 122 are intact. The anchor lugs 124 are operably connected to push rods 126 which cause the anchor lugs 124 to be extended as shown in FIG. 5 when the shear pins 122 are sheared. That is, the push rods 126 are moved downwardly when the shear pins 122 shear and the cylinder 114 is moved towards the anchor member 116. The extended lugs 124 are forced into the sides of the well bore whereby the pipe 112 is anchored to the bottom of the well bore. The lugs 124 dig into the bore hole wall when pipe 112 is moved upwards.

As will be understood, numerous changes in the construction and arrangement of the parts of the slip joints 60 and 80 and the anchor slip joint apparatus 110 can be made by those skilled in the art. In whatever form the slip joint and anchor apparatus, if used, take, their purpose is to maintain the bottom end of the pipe to be cemented in contact with the bottom of the well bore whereby the cement slurry does not surge in the annulus as a result of the reciprocation of the pipe.

In order to further illustrate the methods and apparatus of the present invention the following examples are given.

EXAMPLE 1

Tests were conducted in order to determine if pipe movement during the transition period of a cement slurry could be used to obtain a meaningful delay in static gel strength adhesion and hydrostatic pressure loss. The test apparatus utilized is illustrated in FIG. 6 and generally designated by the numeral 130.

Figure 6:
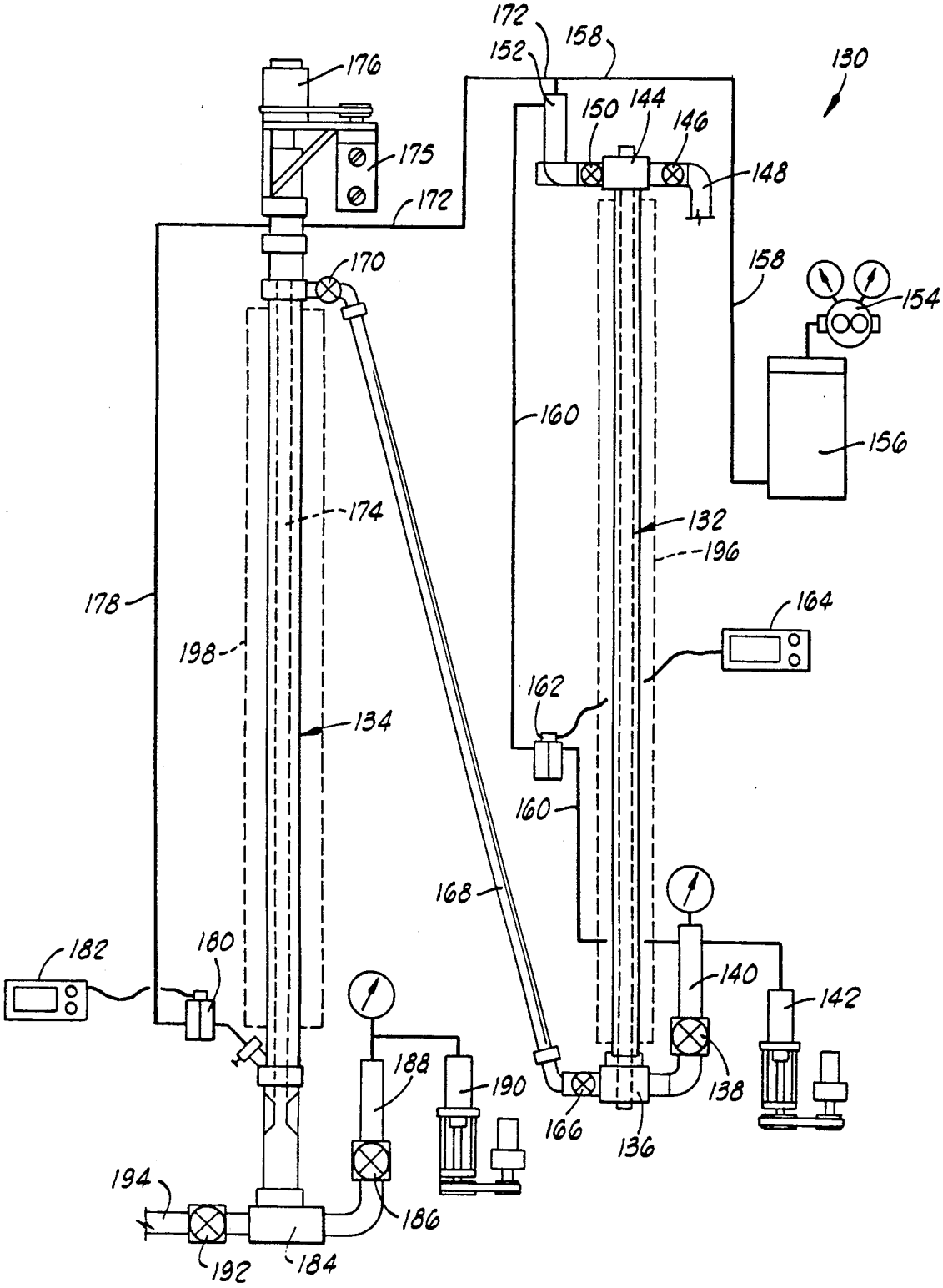
FIG. 6 is a schematic illustration of a test apparatus used for testing the methods of the present invention.

Referring to FIG. 6, the test apparatus included two columns 132 and 134 formed of inner and outer pipes which were identical except that the column 134 was provided with means for rotating or reciprocating the inner pipe. The columns 132 and 134 were each comprised of 2 inch ID outer pipes and 1.05 inch OD inner pipes. The effective heights of the annuluses which were filled with test cement slurries were each about 15 feet. The column 132 included a bottom manifold 136 having a valve 138 connected thereto and to a water separation column 140. A pump 142 was connected to the water separation column 140 by a conduit 141 for withdrawing water therefrom whereby fluid loss from a cement slurry contained in the column 132 could be simulated. The top of the column 132 was connected to a manifold 144. A valve 146 was connected to the manifold 144 and to an outlet and circulation conduit 148. A second valve 150 was connected to the manifold 144 and to a top isolation chamber 152 used to provide an interface between pressurized water therein and a cement slurry in the column 132. A pressure regulator 154 was connected to a source of pressurized nitrogen gas (not shown) and to a gas over water accumulator 156. The accumulator 156 was connected by a conduit 158 to the chamber 152 for providing a constant water pressure at the top of the column 132. A conduit 160 having a differential pressure transducer 162 disposed therein was connected between the water separation chamber 140 at the bottom of the column 132 and the chamber 152 at the top of the column 132. A differential pressure readout device 164 was operably connected to the transducer 162 for indicating the differential pressure across the column 132.

A valve 166 was connected to the manifold 136 at the bottom of the column 132 and to a conduit 168. The other end of the conduit 168 was connected to a valve 170 which was connected to the column 134. A conduit 172 was connected to the top of the column 134 and to the conduit 158 for conducting the same water pressure to the top of the column 134 as was conducted to the top of the column 132. A pipe 174 was rotatably and reciprocatingly disposed within the column 134. For rotation, the pipe 174 was connected to a variable speed drive motor 175 by a magnetic drive apparatus 176. For reciprocation, the drive motor 175 and magnetic drive 176 were replaced with a hydraulically driven cylinder (not shown) which was connected to the pipe 174 by way of a packing gland (not shown). A conduit 178 having a differential pressure transducer 180 disposed therein was connected between the top and bottom of the column 134. A readout 182 was connected to the transducer 180 for indicating the pressure differential across the column 134. The bottom of the column 134 was connected to a manifold 184. A valve 186 connected the manifold 184 to a water separation column 188, and a pump 190 was connected to the column 188 by a conduit 189 for withdrawing water from the column to simulate fluid loss. A valve 192 was connected to the manifold 184 and to a fill conduit 194.

The rotatable or reciprocable pipe 174 disposed within the column 134 simulated casing disposed in a well bore and the outer pipe forming the column 134 simulated a well bore. Both of the columns 132 and 134 were provided with heating water jackets 196 and 198, respectively, for maintaining the columns at the same constant temperature.

In order to determine if rotating and reciprocating the pipe 174 after placing a cement slurry in the column 134 prevented static gel strength adhesion and pressure loss, both the annuluses between the inner and outer pipes of the columns 132 and 134 were filled with the same batch of cement slurry by pumping the slurry by way of the conduit 194 into the annulus between the pipe 174 and the walls of the column 134, through the transfer pipe 168 and into the annulus of the column 132. The columns 132 and 134 were simultaneously heated with hot water circulated through the jackets 196 and 198 to a temperature of 105° F. or 144° F., and both columns were simultaneously pressured at the tops thereof with 500 psi nitrogen gas pressure applied at the accumulator 156. Both columns were also simultaneously subjected to the same simulated fluid loss rate by withdrawing water from the bottoms of the columns using the pumps 142 and 190 at identical rates of from 0.014 to 0.1 inches of cement slurry level drop in the columns per minute.

The cement slurries tested are described in Table 1 below and included a regular low fluid loss slurry, gas migration control slurries, high density with low fluid loss slurries and a lightweight thixotropic slurry.

TABLE 1

Test Cement Slurry Formulations

| Slurry No. | Type of Slurry and Additives[1] | Water, % by weight | Density, lb/gal. |
|---|---|---|---|
| | Regular Slurry | | |
| 1 | Regular Low Fluid Loss Slurry (0.6% retarding fluid loss additive) | 43 | 16.1 |
| | Gas Migration Control (GMC) Slurries | | |
| 2A | 0.8% GMC additive, 35% fine silica, 0.15% retarder | 46 | 16.3 |
| 2B | 0.8% GMC additive, 35% fine silica, 0.08% retarder | 46 | 16.2 |
| 2C | 0.8% GMC additive, 2.0% $CaCl_2$ | 46 | 15.6 |
| 2D | 0.8% GMC additive, 35% fine silica, 2.0% $CaCl_2$ | 46 | 16.3 |
| | High Density Slurries | | |
| 3A | 0.8% dispersing fluid loss additive, 35% fine silica, 25% Hemite | 48 | 17.8 |
| 3B | 0.8% dispersing fluid loss additive, 35% fine silica, 25% Hemite, 2% $CaCl_2$ | 48 | 17.8 |
| | Lightweight Slurry | | |
| 4 | Lightweight Thixotropic Slurry (19% Thixotropic additive, 1.0% non-retarding fluid loss additive) | 160 | 11.7 |

[1]All slurries used Premium Cement.

The general procedure for each test was as follows:

(1) The test system illustrated in FIG. 6 was filled with water and all air was purged therefrom. The system was pressure tested and the valves 138 and 186 were closed.

(2) The columns 132 and 134 were heated to the same test temperature by circulating hot water through the jackets 196 and 198.

(3) The cement slurry to be utilized in the test was mixed and preconditioned.

(4) The water in the columns 132 and 134 was displaced with the test cement slurry by pumping the slurry through the conduit 194, the valve 192, the manifold 184, the annulus in the column 134, the valve 170, the transfer conduit 168, the valve 166, the manifold 136, the column 132, the manifold 144, the valve 146 and the outlet conduit 148.

(5) The test cement slurry was circulated through the test system and through the columns 132 and 134 thereof until the temperature of the cement slurry stabilized.

(6) The circulation was stopped, the test pressure was applied to both of the columns 132 and 134 and the columns were isolated by closing the valves 146 and 166 associated with the column 132 and the valves 170 and 192 associated with the column 134.

(7) The movement of the pipe 174 within the column 134 was started, the valve 138 was opened and the pump 142 was started to simulate fluid loss from the column 132 and the valve 186 was opened and the pump 190 started to simulate fluid loss from the column 134. The increase in resistance to pipe movement was determined electronically as were changes in differential pressure between the top and bottom of each column.

(8) The movement of the pipe 174 was continued until the pressure differential in the column 132 indicated a preselected static gel strength had developed. That is, the differential pressure change in the column 132 was recorded until a cement slurry static gel strength greater or equal to 1,000 pounds per 100 feet was indicated at which time the pipe movement was stopped.

(9) The pressure was maintained for a period of time after stopping the pipe movement after which it was released and the cement was flushed out of the test system.

Separate tests were run with rotation rates from 2.7 to 13.7 feet per minute (peripheral) and with reciprocation rates from 1.7 to 8.6 feet per minute. The reciprocation was off bottom (no slip joint) and as such resulted in an opposing slurry movement with an apparent average velocity of about 28% of the pipe velocity.

The above described mixing, filling and circulation steps 3, 4, 5 and 6 represent mixing, pumping and displacing the slurry to its annulus placement position. Steps 7 and 8 represent the period of pipe rotation or reciprocation following displacement. Step 9 represents the period immediately after the pipe movement is stopped.

The results of the pressure loss tests are given in Tables 2–6 below.

TABLE 2

Pressure Loss At End Of Rotation-Gas Migration Control Cement Slurry No. 2A, 144° F., 500 psi

| Rotation Speed, ft/min | Rotation Time, minutes | Static Gel Strength, lb/100 ft$^2$ | Pressure Loss, psi/100 ft. Rotated Column | Static Column | Rotated Column 5 minutes later |
|---|---|---|---|---|---|
| 13.7 | 206 | 1,000 | 32 | 350 | 400 |
| 6.9 | 223 | 712 | <5 | 250 | 500 |
| 2.7 | 249 | 1,088 | 384 | 381 | >700 |

TABLE 3

Pressure Loss at End of Rotation at 6.87 ft/min, 144° F., 500 psi

| Slurry No. | Test Temperature, °F. | Rotation Time, minutes | Static Gel Strength, lb/100 ft$^2$ | Pressure Loss psi/100 ft. at end of rotation | 5 minutes later |
|---|---|---|---|---|---|
| 2A | 144 | 206 | 716 | <5.0 | 500 |
| 3A | 144 | 335 | 561 | 5.0 | 104 |
| 4 | 105 | 90 | 2,000 | 25.0 | 215 |

TABLE 4

Pressure Loss at End of Reciprocation, 144° F., 500 psi

| Slurry No. | Test Temperature, °F. | Reciprocation Rate, ft/min | Reciprocation Time, minutes | Static Gel Strength lb/100 ft$^2$ (lb/100 ft)[1] | Pressure Loss psi/100 ft. on last Stroke up | down | 5 minutes later |
|---|---|---|---|---|---|---|---|
| 2B | 144 | 8.6 | 118 | 659 (230) | 78 | 22 | 87 |
| 2B | 144 | 1.7 | 119 | 676 (237) | 30 | 24 | 85 |
| 4 | 105 | 7.9 | 43 | 700 (245) | 20 | 5 | 440 |
| 4 | 105 | 1.7 | 46 | 622 (218) | 22 | 10 | 170 |

[1]Pressure loss in static column per 100 ft. of cemented interval in parenthesis.

TABLE 5

Comparison of Rotation and Reciprocation Gas Migration Control Slurry No. 2A, 144° F., 500 psi

| Rate, ft/min | Retarder (HR-4), % by weight | Movement Stopped Time minutes | SGS lb/100 ft$^2$ | Pressure Loss psi/100 ft. at last movement | 5 minutes later |
|---|---|---|---|---|---|
| Rotation | | | | | |
| 6.9 | 0.15 | 206 | 712 | <5.0 | 500 |
| 2.7 | 0.15 | 249 | 1,088 | 348 | >1,000 |
| Reciprocation* | | | | | |
| 8.6 | 0.08 | 118 | 658 | 45 avg | 87 |

TABLE 5-continued

| Comparison of Rotation and Reciprocation Gas Migration Control Slurry No. 2A, 144° F., 500 psi | | | | | |
|---|---|---|---|---|---|
| | Retarder (HR-4), | Movement Stopped | | Pressure Loss psi/100 ft. | |
| Rate, ft/min | % by weight | Time minutes | SGS lb/100 ft$^2$ | at last movement | 5 minutes later |
| 1.7 | 0.08 | 119 | 666 | 16 avg | 170 |

*Reciprocation with end above bottom.

TABLE 6

| Torque and Static Gel Strength Equivalent Near End of Rotation | | | | |
|---|---|---|---|---|
| | | | Static Gel strength psi/100 ft. | |
| Slurry No. | Temperature °F. | Rotation ft/min | Calculated from Torque | Static Column Value |
| 1 | 125 | 13.7 | 18 | 84 |
| 2A | 144 | 2.7 | 70 | 88 |
| 2A | 144 | 2.7 | 73 | 131 |
| 2A | 144 | 6.9 | 23 | 78 |
| 3A | 144 | 6.9 | 80 | 240 |
| 4 | 105 | 6.9 | 67 | 240 |

The results clearly illustrate that low-rate pipe movement effectively delays pressure loss in a cement slurry column until the movement is stopped, even when the movement is continued to a static gel strength value exceeding 1,000 pounds per 100 square feet. As shown in Table 2, the results of the test at a rotation of 13.7 feet per minute shows that when the rotation was continued to a static gel strength of about 1,000 pounds per 100 square feet, the pressure loss was only 32 psi per 100 feet in the column in which the pipe was rotated as compared to a pressure loss of 350 psi per 100 feet in the static column. Five minutes after the rotation was stopped, the pressure loss had increased in the rotated column to 400 psi (equivalent to a gel strength of 1,140 pounds per 100 square feet). This amounts to a very short transition time and indicates that the static gel strength development in the main body of the slurry was not delayed by the low rate pipe rotation used.

As shown in Table 1, four variations of cement slurry with gas migration control additive were tested as well as a high density slurry and a lightweight thixotropic slurry. The results of the test are given in Tables 2 through 6. Although there were some variations attributed to the type of slurry tested, the indications for all the slurries were as follows:

1. Relatively low rate pipe rotation was sufficient to delay cement column pressure loss until the static gel strength in the body of the cement slurry had reached at least about 1,000 pounds per 100 square feet. For rotation, a rate of 6.9 feet per minute was more than sufficient, but 2.7 feet per minute proved to be to low. These rates are equivalent to 5.2 rpm and 2.1 rpm for 5" OD casing.

2. For reciprocation, the minimum rate needed for effective pressure loss delay was apparently much lower than for rotation. A rate of 1.7 feet per minute was sufficient (Table 4).

3. After movement was stopped, pressure restriction developed much faster for rotation than for reciprocation (Table 5). Even so, the pressure restriction recovery was equivalent to transition times of less than 10 minutes.

4. The torques for rotation appear to be significantly less than torques calculated from measured static gel strength values (Table 6).

EXAMPLE 2

Tests to determine the effect of rotation on the cement bond produced were conducted using two identical 4" ID columns having 2⅜ OD pipes disposed therein. The effective test height of the columns was 72 inches. One of the columns included apparatus connected thereto for rotating the inner pipe at a peripheral speed of 10 feet per minute.

The tests were conducted at 75° F. and atmospheric pressure. After filling the columns with a common batch of preconditioned cement slurry, one column remained static and the inner pipe of the other was rotated at a speed of 10 feet per minute. During the pipe rotation, the gel strength in the static column was measured with a rotary viscometer provided with an extra-low speed drive (6.0° per minute). The rotation was continued in the non-static column until a measured torque increase was realized in an amount equivalent to a static gel strength restriction of 200 pounds per 100 square feet. The rotation was then stopped and both columns were cured for seven days. The columns were cut into eight 4" sections and five 8" sections. The 4" sections were tested for shear bond and the 8" sections were tested for hydraulic bond.

The above procedure was then modified by placing water filled flexible diaphragms and layers of heavy mud below the columns and adding pressure transducers to monitor the cement slurry pressure loss. Water was withdrawn from under the flexible diaphragms to simulate fluid loss. Accelerators were added to the slurries used in the tests to obtain realistic set times and transition periods for the test conditions used (75° F. and atmospheric pressure). Gas migration control slurries, a high density slurry and a lightweight thixotropic slurry were tested. The results are set forth in Tables 7 and 8 hereinbelow.

TABLE 7

| Cement Bond, Rotation vs. Static Atmospheric Tests | | | | | | |
|---|---|---|---|---|---|---|
| Slurry No. | Rotation stopped at gel strength Equivalent[b] lb/100 ft$^2$ | Curing Time, Days | Mechanical Shear Bond, psi | | Hydraulic Shear Bond, psi | |
| | | | Static | Rotated[c] | Static | Rotated[c] |
| 2C[a] | 200 | 7 | 110 | 150 | 540 | 920 |
| 2C | 200 | 12 | 86 | 222 | 943 | 940 |
| 2D | 200 | 7 | 202 | 226 | 1,373 | 1,250 |
| 3B | 143 | 14 | 118 | 201 | 870 | 1,080 |
| 4 | 105 | 14 | 37 | 25 | 240 | 190 |

[a]Tests with no fluid loss simulation.
[b]Stopped at a torque equivalent of value shown assuming 100% of static gel strength force reaction.
[c]10 ft/min.

TABLE 8

| Torque Limit and Static Gel Strength Data for Lightweight J-55 Long Threads | | | | | | |
|---|---|---|---|---|---|---|
| Casing | | Maximum Torque | Equivalent Static Gel Strength[a], lb/100 ft$^2$ | | | |
| OD, in. | lb/ft | ft-lb | 500 ft | 1,000 ft | 2,000 ft | 5,000 ft |
| 4.5 | 11.6 | 2,030 | 1,056 | 920 | 460 | 184 |
| 5.5 | 15.5 | 2,530 | 1,560 | 780 | 390 | 156 |
| 7.0 | 23.0 | 2,550 | 1,310 | 654 | 327 | 131 |
| 13.375 | 54.0 | 6,430 | 656 | 329 | 165 | 66 |

TABLE 8-continued

Torque Limit and Static Gel Strength Data for Lightweight J-55 Long Threads

| Casing | | Maximum Torque | Equivalent Static Gel Strength[a], lb/100 ft$^2$ | | | |
|---|---|---|---|---|---|---|
| OD, in. | lb/ft | ft-lb | 500 ft | 1,000 ft | 2,000 ft | 5,000 ft |
| 20.0 | 94.0 | 9,880 | 556 | 226 | 113 | — |

*To keep below API recommended torque.

The test results indicate the following:

1. The pipe rotation at 10 feet per minute increased the mechanical shear bond as compared to static cement slurry conditions except for slurry number 4.

2. The rotation increased the hydraulic bond except for slurry number 4.

3. The rotation torque showed a positive correlation to the gel strength development.

Except for the lightweight cement slurry, the general indication was that initial torque at low static gel strength values was the equivalent of 20% to 50% of torque calculated from static gel strength with a rapidly increasing percentage as the static gel strength approached 300 pounds per 100 square feet. The extremely low-strength potential of the lightweight cement apparently allowed a measurable disruption of strength development in the fluidized layer produced in the rotated column.

Thus, the present invention is well adapted to carry out the objects and attain the ends and advantages mentioned as well as those which are inherent therein. While numerous changes to the methods and apparatus of this invention may be made by those skilled in the art, such changes are encompassed within the spirit of this invention as defined by the appended claims.

What is claimed is:

1. A method of substantially preventing the flow of gas from a gas-containing subterranean formation into a cement slurry in a well bore which penetrates said formation while cementing a pipe in said well bore, said method being comprised of the steps of:

a. placing a hydraulic cement slurry in the annulus between said pipe and said well bore;

b. maintaining the hydrostatic pressure exerted by said slurry on said formation during the transition period of said slurry by movement of said pipe during said transition period; and c. terminating said movement of said pipe when said slurry develops sufficient gel strength to substantially block said flow of said gas;

wherein said movement of said pipe is performed at a rate which will maintain a thin layer of said slurry next to said pipe in a fluid state, but which will not disturb the column of cement to the point which would prevent attainment by said slurry of said sufficient gel strength wherein said movement of said pipe comprises continuously rotating said pipe at a peripheral surface speed in the range of from about 7 to about 30 feet per minute.

2. The method of claim 1 wherein said pipe is rotated at a higher speed during an initial part of said transition period and at a slower speed during the latter part of said period.

3. The method of claim 1 wherein the movement of said pipe is stopped when said cement slurry develops a gel strength of about 500 pounds per 100 square feet.

4. The method of claim 1 wherein said hydraulic cement slurry is placed by pumping said slurry downwardly through said pipe and then upwardly in said annulus.

5. A method of substantially preventing the flow of gas through a well bore penetrating one or more gas-containing formations while cementing a pipe in said well bore, said method comprising the steps of:

pumping a hydraulic cement slurry downwardly through said pipe and upwardly into the annulus between said pipe and said well bore;

maintaining the hydrostatic pressure exerted by said slurry on said gas-containing formations during the transition period of said slurry by continuously moving said pipe during said transition period to thereby substantially prevent gas flow into said slurry and said well bore; and stopping the movement of said pipe when said slurry develops a gel strength of about 500 pounds per 100 square feet whereby gas flow through said well bore is blocked as said slurry sets;

wherein said movement of said pipe is performed at a rate which will maintain a thin layer of said slurry next to said pipe in a fluid state, but which will not disturb the column of cement to the point which would prevent development by said slurry of said gel strength wherein said pipe is rotated at a peripheral surface speed in the range of from about 7 to about 30 feet per minute.

6. The method of claim 5 wherein said pipe is rotated at a peripheral surface speed in the range of from about 7 to about 30 feet per minute.

* * * * *